US008004465B2

(12) United States Patent
Schano

(10) Patent No.: US 8,004,465 B2
(45) Date of Patent: Aug. 23, 2011

(54) MULTIBAND OMNIDIRECTIONAL ANTENNA

(75) Inventor: Thomas Schano, Giesen (DE)

(73) Assignee: Robert Bosch GmbH, Stuttgart (DE)

( * ) Notice: Subject to any disclaimer, the term of this patent is extended or adjusted under 35 U.S.C. 154(b) by 226 days.

(21) Appl. No.: 12/084,936

(22) PCT Filed: Oct. 31, 2006

(86) PCT No.: PCT/EP2006/067981
§ 371 (c)(1),
(2), (4) Date: Mar. 10, 2009

(87) PCT Pub. No.: WO2007/057300
PCT Pub. Date: May 24, 2007

(65) Prior Publication Data

US 2009/0303131 A1 Dec. 10, 2009

(30) Foreign Application Priority Data

Nov. 21, 2005 (DE) ..... 10 2005 055 345

(51) Int. Cl.
*H01Q 1/38* (2006.01)

(52) U.S. Cl. ..... 343/700 MS; 343/713

(58) Field of Classification Search ..... 343/700 MS, 343/711, 712, 713
See application file for complete search history.

(56) References Cited

U.S. PATENT DOCUMENTS

| | | | | |
|---|---|---|---|---|
| 4,821,040 | A * | 4/1989 | Johnson et al. | 343/700 MS |
| 6,597,316 | B2 * | 7/2003 | Rao et al. | 343/700 MS |
| 7,158,086 | B2 * | 1/2007 | Inatsugu et al. | 343/711 |
| 7,495,621 | B2 * | 2/2009 | Li et al. | 343/702 |
| 7,733,279 | B2 * | 6/2010 | Hozouri | 343/702 |
| 2004/0004572 | A1 * | 1/2004 | Ma | 343/700 MS |
| 2005/0195111 | A1 | 9/2005 | Inatsugu | |

FOREIGN PATENT DOCUMENTS

| | | |
|---|---|---|
| EP | 1 445 828 | 8/2004 |
| FR | 2 826 185 | 12/2002 |

* cited by examiner

*Primary Examiner* — HoangAnh T Le
(74) *Attorney, Agent, or Firm* — Kenyon & Kenyon LLP

(57) ABSTRACT

A multiband omnidirectional antenna which includes a grounded face and an antenna element situated parallel to the grounded face, the antenna element having a first planar emitter, which has a planar design and extends parallel to the grounded face, a second planar emitter, which surrounds the first planar emitter at a distance, and at least two connection elements for connecting the first and the second planar emitters to each other.

7 Claims, 2 Drawing Sheets

(A-A)

(B-B)

(C-C)

MULTIBAND OMNIDIRECTIONAL ANTENNA

FIELD OF THE INVENTION

The present invention relates to a multiband omnidirectional antenna, in particular for installation in a vehicle body.

BACKGROUND INFORMATION

Modern vehicles are increasingly equipped with radio and communication devices which need suitable antenna structures for transmitting and receiving radio signals. If possible, the antenna structures should not protrude from the vehicle body, because they could interfere with the design of the vehicle shell. For this reason it is desirable to install antenna structures into the body in such a way that they do not protrude beyond the vehicle shell. This is known already for reception systems such as radio and TV reception systems which to some extent use multiple antennas to obtain a desired omnidirectional reception. Moreover, amplifiers are used in order to be able to keep the losses, caused by the maladjustment to typical antenna cables, low or even equalize them.

However, for cellular radio systems, for example, the use of an amplifier for impedance adjustment is generally too expensive; that is why the antenna structures were previously provided with suitable impedances which, however, for lack of space had to be installed in such a way that they protruded beyond the vehicle shell.

Therefore, it is an object of the exemplary embodiments and/or exemplary methods of the present invention to provide a multiband omnidirectional antenna for use in cellular radio systems whose impedance may be adjusted and which has a low installation height so that it may be placed within the vehicle shell.

SUMMARY OF THE INVENTION

This object is achieved by the multiband omnidirectional antenna described herein.

Additional advantageous embodiments of the present invention are also described herein.

According to the exemplary embodiments and/or exemplary methods of the present invention, a multiband omnidirectional antenna is provided having a grounded face and an antenna element situated parallel to the grounded face. The antenna element has a first planar emitter which has a planar design and extends parallel to the grounded face, and a second planar emitter which surrounds the first planar emitter at a distance. Moreover, the antenna element includes at least two connecting elements which connect the first planar emitter and the second planar emitter to one another.

In this way, a multiband omnidirectional antenna may be provided which has a low installation height and is thus suitable for installation in a vehicle shell without protruding from it.

The first planar emitter and the second planar emitter may be coplanar to one another.

The connecting elements may essentially be situated on opposite edges of the first planar emitter to obtain a suitable current distribution in the planar emitters.

The first planar emitter may be rectangular and the second planar emitter has a rectangular border, the second planar emitter surrounding the edge of the first planar emitter at a distance so that the second planar emitter may be designed as a circumferential strip around the first planar emitter.

According to an exemplary embodiment, a third planar emitter may be provided which surrounds the second planar emitter at a wider distance and is designed, in particular, to be rectangular and coplanar with the first planar emitter and the second planar emitter, the connecting elements each connecting the first, the second, and the third planar emitters to one another.

In particular, at least one of the connecting elements may have an electronic component to make it possible to exactly adjust the impedances of the multiband omnidirectional antenna.

Furthermore, the omnidirectional antenna may have a ground connection structure for connecting the grounded face to the antenna element and a supply connection structure to supply the antenna element with a transmitting signal.

The ground connection structure may be planar, in particular rectangular or trapezoidal, and contacts the first planar emitter with an edge along a ground connection area on the first planar emitter. The ground connection area runs essentially parallel to the edge of the first planar emitter, to which one of the connection elements is connected.

According to a further specific embodiment of the present invention, the supply connection structure may have a planar, in particular a circle segment-shaped, in particular a semicircular or an ellipse segment-shaped, in particular semielliptical design. The supply connection structure contacts the first planar emitter at its straight edge along a supply connection area on the first planar emitter, the supply connection area running essentially parallel to an edge of the first planar emitter, to which another one of the connection elements is connected.

At least one of the supply connection area and the ground connection area may extend within a plane formed by contact points of the connection elements with the first planar emitter.

Exemplary embodiments of the present invention are described in greater detail in the following based on the enclosed drawings.

DETAILED DESCRIPTION

Figure 1:
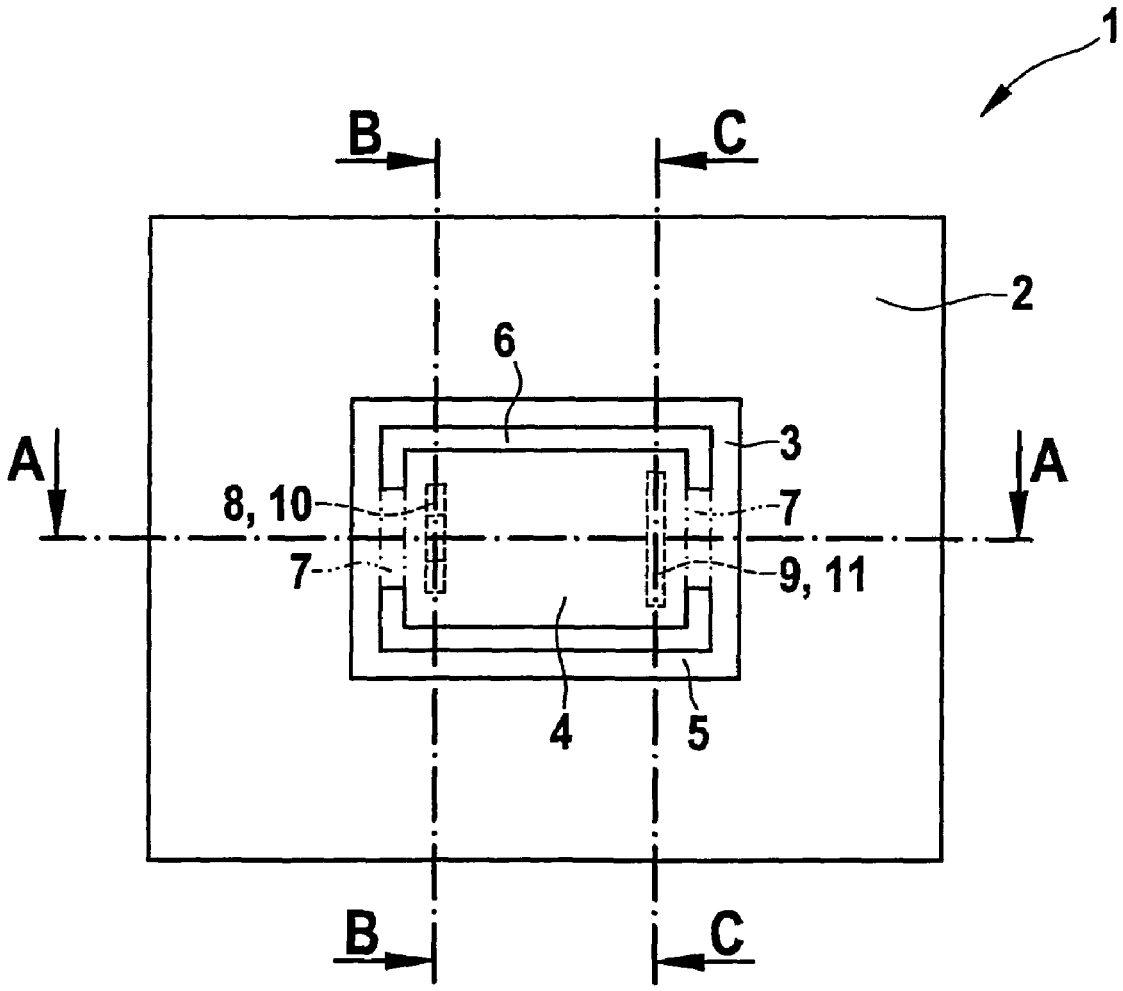
FIG. 1 shows a top view onto the multiband omnidirectional antenna according to an exemplary embodiment of the present invention.

FIG. 1 shows a top view onto a multiband omnidirectional antenna 1 according to an exemplary embodiment of the present invention. Multiband omnidirectional antenna 1 has a grounded face 2 which has a conductive, in particular metallic, surface. A planar antenna element 3, which is also made of a conductive material and has a conductive surface, is situated essentially plane-parallel at a certain first distance above the surface of grounded face 2. Antenna element 3 may be manufactured as a stamped part in particular.

Planar antenna element 3 has a first planar emitter 4 which has an essentially square, which may be a rectangle, shape. First planar emitter 4 is surrounded by a second planar emitter 5 whose outer edges also form a rectangle. Second planar emitter 5 surrounds the first planar emitter which may be at a predefined second distance so that a slot 6 is formed between first planar emitter 4 and second planar emitter 5. First planar emitter 4 and second planar emitter 5 are connected to one another via connection elements 7, the connection elements being situated on opposite edges of first planar emitter 4 and thus forming an electrical connection between first planar emitter 4 and second planar emitter 5.

First and second planar emitters 4, 5 each have different impedances and are thus optimized for different transmission frequencies. The dimensions of the first planar emitter and the second planar emitter, the distance between the first planar emitter and the second planar emitter, and the size of connection elements 7 are coordinated in order to set the impedance of the respective planar emitter 4, 5.

Figure 2:
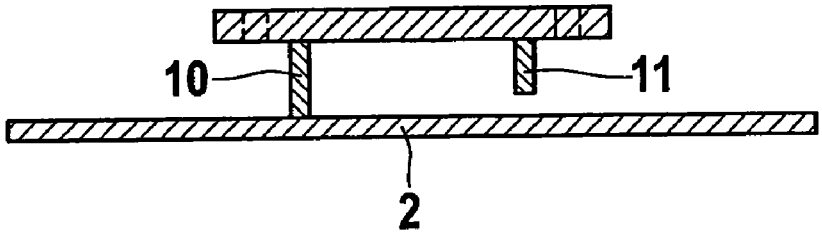
FIG. 2 shows a sectional view through the multiband omnidirectional antenna of FIG. 1 along section line A-A.
Figure 3:
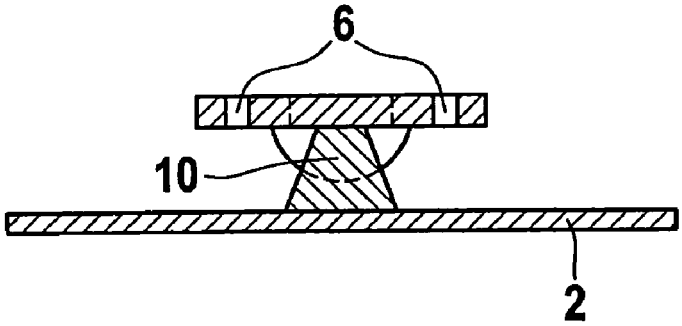
FIG. 3 shows a sectional view through the multiband omnidirectional antenna of FIG. 1 along section line B-B.
Figure 4:
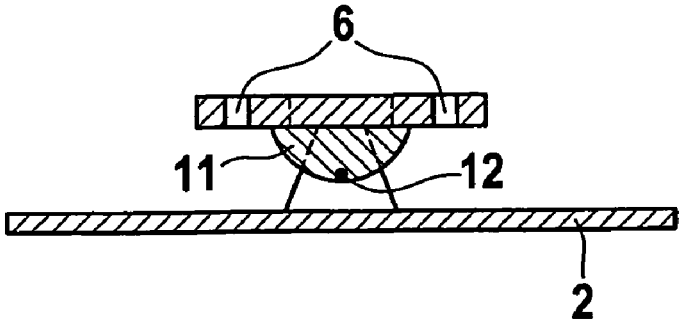
FIG. 4 shows a sectional view through the multiband omnidirectional antenna of FIG. 1 along sectional line C-C.

First planar emitter 4 has a ground connection area 8 to provide antenna element 3 with a ground potential, and a supply connection area 9 to provide antenna element 3 with the transmission signal or the transmission signals. To apply the ground potential to antenna element 3, a ground connection element 10 (see FIG. 2) is provided which is situated between antenna element 3 and grounded face 2. Ground connection element 10 is used as a spacer element between grounded face 2 and antenna element 3 and is planar and designed as a bar which is connected to grounded face 2 and ground connection area 8 of antenna element 3. Ground connection element 10 has a quadrangular, in particular rectangular or trapezoidal, design. Ground connection area 8 has an essentially oblong design so that an edge of ground connection element 10 is in contact with it. A trapezoidal embodiment of ground connection element 10 is shown in FIG. 3, for example, which shows a sectional view through the multiband omnidirectional antenna of FIG. 1 along sectional line B-B.

A supply connection element 11, which protrudes from antenna element 3 in particular at a right angle in the direction of grounded face 2, is situated in supply connection area 9 in such a way that supply connection element 11 is situated between antenna element 3 and grounded face 2. Supply connection element 11 may be a circle segment-shaped or ellipse segment-shaped, in particular semicircular or semielliptical, and its straight edge is in contact with supply connection area 9 of antenna element 3. However, supply connection element 11 is not in contact with grounded face 2, but rather has a contact point 12 on its curved edge which may be on its end facing grounded face 2 via which the transmission signal is supplied to antenna element 3. The semicircular or semielliptical design of supply connection element 11 makes an appropriate current distribution in antenna element 3 possible. Multiband omnidirectional antenna 1 is connected, for example, by connecting a coaxial cable (not shown) in the area of supply connection element 11 in such a way that the inner conductor of the coaxial cable is connected to contact point 12 and the outer conductor is connected to grounded face 2.

First and second planar emitters 4, 5 may have a square or rectangular cross section. In the present exemplary embodiment, first planar emitter 4 is essentially rectangular, connecting elements 7 being situated on its shorter edges. Connecting elements 7 may be in the form of a bar whose contact length with first planar emitter 4 is shorter than the overall length of the shorter edge of rectangular first planar emitter 4. Furthermore, connecting elements 7 are connected to first planar emitter 4 in such a way that, with regard to a symmetry line, they are symmetrical along a center line. Second planar emitter 5 may be symmetrically situated along this symmetry line. First planar emitter 4, connecting elements 7, and second planar emitter 5 may be manufactured integrated, from a stamped part, for example. However, it may also be provided that first and second planar emitters 4, 5 are designed to be separated from one another and connecting elements 7 are designed in the form of electronic components, e.g., in the form of a resistor, an inductor and/or a capacitor in order to set the necessary impedance of antenna element 3.

Ground connection area 8 and supply connection area 9 are situated in first planar emitter 4 and run essentially parallel to the longitudinal dimension of connecting elements 7. Ground connection area 8 and supply connection area 9 may be situated in the proximity of the respective shorter edge of first planar emitter 4, may be at a distance from the shorter edge which is between 0% to 20% of the length of the longer edge of first planar emitter 4. Ground connection area 8 is thus situated close to a first shorter edge of first planar emitter 4 in the area of a first of connecting elements 7 and supply connection area 9 is situated close to a second shorter edge of first planar emitter 4 in the area of a second of the connecting elements.

Connection areas 8, 9 essentially run with their longitudinal dimension parallel to the respective shorter edge of first planar emitter 4 and within a surface which is formed by the ends of a contact line between one of the respective connecting elements 7 and first planar emitter 4. The two planar emitters 4, 5 are electrically connected essentially via two bar-shaped connecting elements 7 whose shared symmetry line and the symmetry line of the ground connection area and the supply connection area form a shared plane.

In order to be able to set more than two favored transmission frequencies, further planar emitters may be provided in addition to first and second planar emitters 4,5 which extend coplanarly and two-dimensionally around the outer edge of the second planar emitter at a certain farther distance, connecting elements 7 connecting first and second planar emitters 4,5 and all other planar emitters to one another.

What is claimed is:

1. A multiband omnidirectional antenna, comprising:

a grounded face;

an antenna element situated parallel to the grounded face;

wherein the antenna element includes a first planar emitter, which has a planar design and extends parallel to the grounded face, a second planar emitter, which surrounds the first planar emitter at a distance, and at least two connection elements for connecting the first and the second planar emitters to each other, the connection elements being essentially situated on, and running alongside, opposite edges of the first planar emitter;

a ground connection structure to physically connect the grounded face to the antenna element, and to support the antenna element, the ground connection structure located near, and running substantially parallel to, a first one of the connection elements; and a supply connection structure to supply the antenna element with a transmission signal via a contact point that does not provide any substantial physical support for the antenna element, the supply connection structure located near, and running substantially parallel to, a second one of the connection elements;

wherein the dimensions of the first planar emitter and the second planar emitter, the distance between the first planar emitter and the second planar emitter, and the size of the connection elements are all selected to provide the first planar emitter and the second planar emitter with predetermined impedances that differ from one another.

2. The omnidirectional antenna of claim 1, wherein the first and the second planar emitters are coplanar with respect to each other.

3. The omnidirectional antenna of claim 1, wherein the first planar emitter has a rectangular design and the second planar emitter has a rectangular border.

4. The omnidirectional antenna of claim 1, wherein a third planar emitter surrounds the second planar emitter at a farther distance and is rectangular and coplanar with respect to the first and the second planar emitters, the connection elements connecting the first, second, and third planar emitters to one another.

5. The omnidirectional antenna of claim 1, wherein at least one of the connection elements has an electronic component that includes at least one of a resistor, an inductor and a capacitor, each electronic component contributing to an predetermined impedance of the antenna element.

6. The omnidirectional antenna of claim 1, wherein the ground connection structure includes a planar rectangular or trapezoidal arrangement and contacts the first planar emitter with an edge along a ground connection area on the first planar emitter, the ground connection area running essentially parallel to the edge of the first planar emitter, to which the first one of the connection elements is connected.

7. The omnidirectional antenna of claim 1, wherein the supply connection structure has a planar circle segment-shaped or a semicircular segment shaped, an ellipse segment-shaped, or a semielliptical segment shaped arrangement and contacts the first planar emitter with a straight edge along a supply connection area on the first planar emitter, the supply connection area running essentially parallel to the edge of the first planar emitter, to which the second one of the connection elements is connected.

* * * * *